US006102718A

United States Patent [19]

Kumakura et al.

[11] Patent Number: 6,102,718

[45] Date of Patent: Aug. 15, 2000

[54] LOW INSERTING FORCE CONNECTOR

[75] Inventors: Hideto Kumakura; Nobuyuki Akeda, both of Shizuoka, Japan

[73] Assignee: Yazaki Corporation, Tokyo, Japan

[21] Appl. No.: 09/223,781

[22] Filed: Dec. 31, 1998

[30] Foreign Application Priority Data

Jan. 22, 1998 [JP] Japan ..... 10-010644

[51] Int. Cl.[7] ..... H01R 13/62

[52] U.S. Cl. ..... 439/157

[58] Field of Search ..... 439/157, 355, 439/347, 159

[56] References Cited

U.S. PATENT DOCUMENTS 5,308,255 5/1994 Yamanashi ..... 439/157

5,641,293 6/1997 Tsuji ..... 439/157

FOREIGN PATENT DOCUMENTS 4-319271 11/1992 Japan .

*Primary Examiner*—Lincoln Donovan
*Assistant Examiner*—Javaid Nasri
*Attorney, Agent, or Firm*—Armstrong, Westerman, Hattori, McLeland & Naughton

[57] ABSTRACT

A low inserting force connector comprising a male and female connectors to be smoothly engaged and disengaged with a low force is provided. A pair of sliders are point-symmetrically formed along the upper and lower walls of a female connector housing. The sliders are provided with cam portions, and a male connector housing is provided with stopper protrusions to be engaged with the cam portions. The sliders are accommodated in the female connector housing, so that the inlets of the cam portions are situated in the center of the housing in the transverse direction. Follower protrusions are formed on the sliders, and guide slits are point-symmetrically formed through the female connector housing. The female and male connector housings can be inserted into a connector casing, and the connector casing is point-symmetrically provided with cam portions for receiving the follower protrusions. The male connector housing is provided with sliding portions and a temporary engaging portion, and the connector casing is provided with guide portions and a lock portion. The female connector housing and the connector casing are provided with lock portions to be engaged with attachment portions of mating objects.

7 Claims, 6 Drawing Sheets

LOW INSERTING FORCE CONNECTOR

BACKGROUND OF THE INVENTION

1. Field of the Invention

The present invention relates to a low inserting force connector which comprises a male connector and a female connector to be engaged and disengaged by moving a pair of sliders in opposite direction with a low force.

2. Description of the Related Art

FIG. 9 shows an example of the low inserting force connector of the prior art.

This low inserting force connector comprises a connector casing 75, a connector housing 76 slidable inside the connector casing 75 in the connector engagement direction, and a slider 77 inserted from the outside of the connector casing 75 in the center of the connector housing 76 in a direction perpendicular to the connector engagement direction.

The slider 77 is provided with a cam groove (not shown), and the connector housing 76 is provided with a stopper protrusion to be engaged with the cam groove. By pushing the slider 77, the stopper protrusion moves along the cam groove, and the connector housing 76 is then engaged with a mating connector (not shown) inside the connector casing 75 with a low force.

In the above structure, however, there is a large dead space 78 inside the connector housing 76, due to the slider 77 being situated in the center of the connector housing 76. As a result, the number of terminal receiving chambers 79 is reduced by the space 78. If extra terminal receiving chambers are added outside, the size of the connector housing 76 becomes too large. This also makes the shape of the connector housing 76 more complicated, and workability in resin molding to form the connector housing 76 deteriorates accordingly.

To solve those problems, a low inserting force connector shown in FIG. 10 is disclosed in Japanese Patent Laid-Open No. 4-319271.

This low inserting force connector comprises a female connector housing having male terminals (not shown) protruding inward, a slider 82 provided with a pair of sliding plates 81 and 81' to be inserted into the female connector housing 80, a connector casing 83 to be inserted into the female connector housing 80, and a male connector housing 84 to be engaged with the connector casing 83.

The sliding plates 81 and 81' are provided with cam grooves 85 and 85', and the connector casing 83 is provided with stopper protrusions 86 and 86' to be engaged with the cam grooves 85 and 85'. The male connector housing 84 is engaged with the connector casing 83, the slider 82 is inserted into the female connector housing 84, the connector casing 83 is initial-engaged with the female connector housing 80, and the female connector housing 80 and the male connector housing 84 are then engaged with each other by pushing the slider 84 with a low force.

In this example, the sliding plates 81 and 81' are situated on both sides of the female connector housing 80, instead of in the center of it. This allows more space for terminals 87 and reduces the dead space. Also, the connector housings 80 and 84 can be simplified, and workability in resin molding can be improved.

However, since the pair of sliding plates 81 and 81' are inserted in the same direction, the insertion force acts on the connector housing 80 and the connector casing 83 in the same direction, often resulting in dislocation or tilt of the connector housings 80 and 84 or the sliding plates 81 and 81'. Also, it is difficult to produce the sliding plates 81 and 81' by resin molding, and the manufacturing cost of the slider 82 becomes high accordingly. Further, the handling portion 88 used to push and pull the slider 82 considerably protrude outward, which makes the connector too large in the longitudinal direction and the slider 82 obstructive to other objects. Pushing and pulling the slider 82 also makes the connector engagement and disengagement operations more troublesome and complicated.

SUMMARY OF THE INVENTION

In view of the foregoing problems, the present invention is aimed at providing a low inserting force connector with which connector engagement can be smoothly carried out. The sliders used for such a low inserting force connector can be produced at low cost. With those sliders being not obstructive, the connector itself can be made compact, and no troublesome operation is necessary in handling the sliders.

To achieve the above object, the low inserting force connector of the present invention is provided with a pair of sliders formed slidably along the upper and lower walls of the female connector housing. The sliders are provided with cam portions, and the male connector housing is provided with stopper protrusions to be engaged with the cam portions. The sliders are point-symmetrically formed and arranged, and slide in opposite directions. With this structure, the force exerted from the sliders being moved is doubled and then acts equally on both connectors, so that the male and female connector housings can be smoothly engaged and disengaged. Since the sliders are identical, the same mold can be used in manufacturing the sliders, thus reducing the manufacturing cost.

The sliders are inserted into the female connector housing, and the inlets of the cam portions are situated in the center of the female connector housing in its transverse direction. The stopper protrusions are situated in the center of the male connector housing in its transverse direction. With this structure, the sliders slide only inside the female connector housing, and never protrude outward and become obstructive. Thus, the attachment portions can be made smaller, and the connector itself can be made compact.

The sliders are provided with follower protrusions, and the female connector housing is point-symmetrically provided with guide slits for the follower protrusions. The female connector housing and the male connector housing can be inserted into a connector casing. The connector casing is point-symmetrically provided with cam portions for the follower protrusions. With this structure, the follower protrusions of the sliders move along the cam portions of the connector casing, as the female connector housing is inserted into the connector casing. Also, the stopper protrusions of the male connector housing inside the connector casing move along the cam portions of the sliders in the direction of connector engagement. Thus, no troublesome operation of pushing the sliders is necessary, because the connectors can be automatically engaged with each other with a low force. By simply pulling the female connector housing out, the connectors can also be automatically disengaged without pulling the sliders out.

The male connector housing is provided with sliding portions in the connector engagement direction and a temporary engaging portion. The connector casing is provided with guide portions to be engaged with the sliding portions, and a locking mechanism for the temporary engaging portion. With this structure, as the sliding portions are engaged with the guide portions, the male connector housing can be smoothly guided into the connector casing, and temporarily engaged by the temporary engaging portion and the locking mechanism. Thus, the initial engagement position of the male connector housing with respect to the female connector housing can be accurately set.

The female connector housing and the connector casing are provided with locking portions to be engaged with attachment portions of mating objects. With this structure, when attached to mating objects such as an instrument panel and a meter unit, both connector housings can be automatically engaged with each other with a low force, thereby facilitating the attaching operation.

The above and other objects and features of the present invention will become more apparent from the following description taken in conjunction with the accompanying drawings.

DESCRIPTION OF THE PREFERRED EMBODIMENTS

The following is a detailed description of the embodiments of the present invention, with reference to the accompanying drawings.

FIGS. 1 to 7 illustrate one embodiment of the low inserting force connector of the present invention.

Figures 1, 1A:
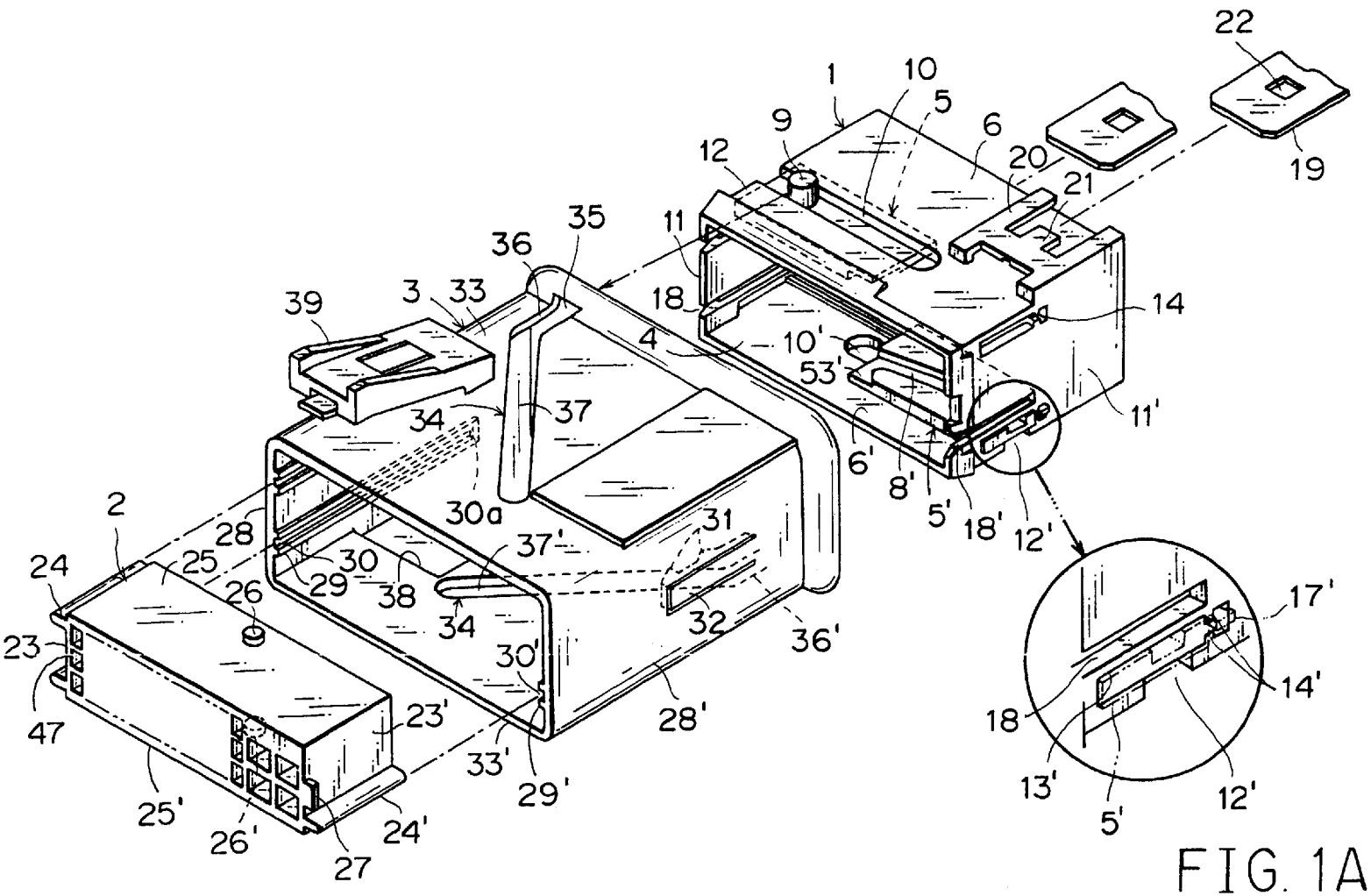
FIG. 1 is an exploded perspective view of one embodiment of the low inserting force connector in accordance with the present invention.
Figure 2:
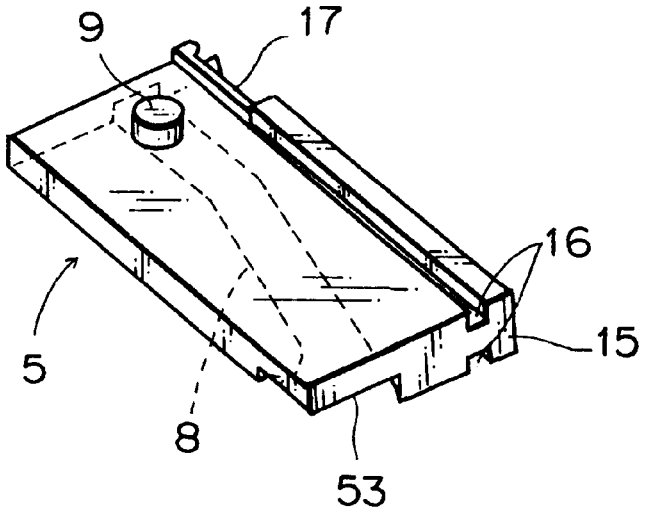
FIG. 2 is a perspective view of a slider.

FIG. 1 shows a synthetic-resin female connector housing 1, a synthetic-resin male connector housing 2, and a synthetic-resin connector casing 3 for accommodating both connector housings.

A pair of identical synthetic-resin sliders 5 and 5' are disposed in the connector engaging chamber 4 of the female connector housing 1. The sliders 5 and 5' are laterally point-symmetrical (i.e., 180-degree rotation-symmetrical) to each other. More specifically, the first flat slider 5 is arranged in the left half of the upper wall 6 of the female connector housing 1, while the second flat slider 5' is arranged in the right half of the lower wall 6' of the female connector housing 1, as can be seen from FIGS. 1 and 3.

Figure 3:
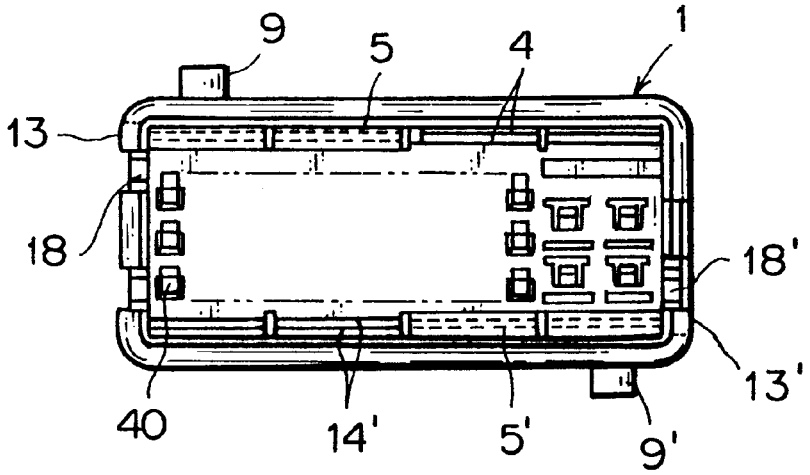
FIG. 3 is a plan view illustrating the arrangement of the sliders inside the female connector housing.

The edges of the sliders 5 and 5' are situated near the center of the female connector housing 1, and cam grooves 8 and 8' are formed on the inner surfaces of the sliders 5 and 5'. Short cylindrical follower protrusions 9 and 9' are formed on the outer surfaces of the sliders 5 and 5' on their respective base sides, as shown in FIG. 3. The follower protrusions 9 and 9' are slidably engaged with guide slits 10 and 10' formed through the upper wall 6 and the lower wall 6' of the female connector housing 1. The guide slits 10 and 10' are laterally pointsymmetrical to each other and extend in a direction perpendicular to the direction of connector engagement. The guide slits 10 and 10' are also longer than the sliders 5 and 5', and the bases of them are formed by cutting the side walls 11 and 11'. The follower protrusions 9 and 9' enter the guide slits 10 and 10' through the cut-out openings 12 and 12'. The cut-out openings 12 and 12' communicate with inner slider insertion slits 13 and 13'.

Two pairs of guide rails 14 and 14' facing to each other are formed on the bottoms (on the rear side in the connector engagement direction) of the slider insertion slits 13 and 13', and the guide rails 14 and 14' horizontally communicate with the bottom of the connector engaging chamber 4. A pair of engaging grooves 16 and 16' for receiving the guide rails 14 and 14' are provided to each of the bottoms 15 and 15' (on the rear side in the connector engagement direction) of the sliders 5 and 5'. Flexible lock arms 17 and 17' for engaging the rims of the slider insertion slits 13 and 13' are formed on the rear sides of the bottoms 15 and 15'.

The sliders 5 and 5' are supported by the guide rails 14 and 14' and the follower protrusions 9 and 9', respectively, so that they are slidable inside the connector engaging chamber of the female connector housing 1 in the direction perpendicular to the direction of connector engagement. The sliders 5 and 5' never protrude out of the female connector housing 1. They only moves inside the connector engaging chamber 4. The sliders 5 and 5 ' are identical to each other, and take the form of flat plates having a relatively simple shape. Thus, the receiving space inside the female connector housing 1 can be small, and a mold for the sliders 5 and 5' can be easily produced.

On both side walls 11 and 11', guide slits 18 and 18' for the male connector housing 2 are formed on the inner surface of the slider insertion slits 13 and 13'. On the outer surfaces of the upper wall 6 and the lower wall 6' of the female connector housing 1, slide engaging portions (fixing portions) 20 are formed for receiving a pair of through brackets 19 formed on a meter unit or a door trim. A flexible lock arm 21 is formed in the center of each slide engaging portion 20. The protrusion of the lock arm 21 is engaged with an engaging hole 22 of the through bracket 19, so that the female connector housing 1 can be fixed to the attachment portion of the mating object.

Slide streak plates 24 and 24 ' to be inserted into the guide slits 18 and 18' are formed on both side walls 23 and 23' of the male connector housing 2. On the upper wall 25 and the lower wall 25' of the male connector housing 2, short cylindrical engaging protrusions 26 and 26 ' to be inserted into the cam grooves 8 and 8' of the sliders 5 and 5' are formed in the center on the side of engagement. A temporary engaging protrusion 27 for engaging the connector casing 3 is formed at the bottom side of one side wall 23' of the male connector housing 2.

Guide rails 29 and 29' with guide grooves 30 and 30' in the center for receiving and guiding the slide streak plates 24 and 24' of the male connector housing 2 are formed on the side walls 28 and 28' of the connector casing 3 in the direction of the connector engagement. A stopper **30*a* is provided to the stop end of each of the guide grooves 30 and 30'. A flexible lock arm 32 provided with a pair of engaging protrusions 31 for the temporary stopper protrusion 27 of the male connector housing 2 is formed on the side wall 28'**.

Cam slits 34 and 34' for the follower protrusions 9 and 9' of the sliders 5 and 5' are point-symmetrically formed on the upper wall 33 and the lower wall 33' of the connector casing 3. The cam slits 34 and 34' are formed by straight portions 36 and 36' extending from the inlet portion 35 at the edge of the connector casing 3, and inclined portions 36 and 36' extending from the straight portions 36 and 36'. The inclined portions 37 and 37' extend to the center of the connector casing 3.

Concave portions 38 for receiving the slide engaging portions 20 of the female connector housing 1 are formed on the upper wall 33 and the lower wall 33' of the connector casing 3. Lock arms 39 for the attachment portion of the mating side (not shown) such as an instrument panel or a door panel are formed on the upper wall 33, the lower wall 33', and the side walls 28 and 28'.

In this embodiment, the female connector housing 1 is fixed beforehand to the through bracket 19 of a meter unit or the like, and the connector casing 3 is fixed to an instrument panel with the male connector housing 2 being temporarily engaged therewith. When the meter unit is attached to the instrument panel, the connector housings 1 and 2 are engaged with a low force. Thus, attachment to the meter unit can be easily done with a low force.

More specifically, male terminals with wires are inserted into the female connector housing 1, while female terminals with wires are inserted into the male connector housing 2, thereby forming a female connector and a male connector to be engaged with each other. It is of course possible to engage the connector housing 1 and 2 by hands without the slide engaging portions 20 or the lock arms 39. Since the sliders 5 and 5' do not stick out after the engagement, they never interfere with other components. Thus, the sliders 5 and 5' can be prevented from being damaged, and the two connectors can be attached and engaged in a restricted space.

As shown in FIG. 3, a plurality of terminal receiving chambers 40 are formed in the female connector housing 1. Flange-like bracket (not shown), instead of the slide engaging portions 20, may be integrally formed on the female connector housing 1. Such brackets will be fixed to a meter unit with a bolt.

Figure 4:
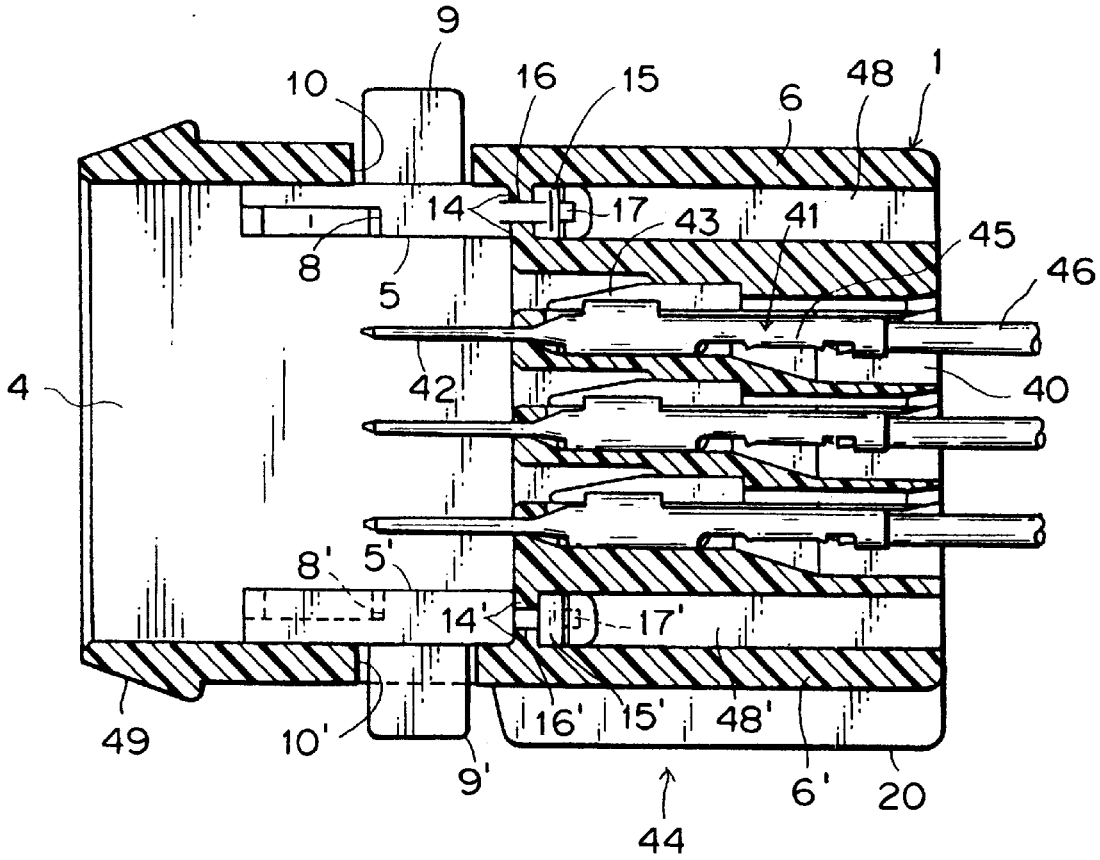
FIG. 4 a vertical sectional view of the female connector.

As shown in FIG. 4, male terminals 41 are inserted into the terminal receiving chambers 40 of the female connector housing 1, and held by flexible stopper lances 43, thereby forming a female connector 44. Tabs 42 of the male terminals 41 protrude into the connector engaging chamber 4, and wires 46 are connected to crimping portions 45. Female terminals (not shown) are inserted into terminal receiving chambers 47 of the male connector housing 2 shown in FIG. 1, thereby forming a male connector. The female connector 44 provided with the sliders 5 and 5 ', the connector casing 3, and the male connector make up a low inserting force connector.

Spaces 48 and 48' are formed between the upper wall 6 and the top terminal receiving chamber 40, and the lower wall 6' and the bottom terminal receiving chamber 40 of the female connector housing 1, as shown in FIG. 4. The guide rails 14 and 14 ' are situated on the boundary between the connector engaging chamber 4 and the spaces 48 and 48', and bottoms 15 and 15' communicating with the engaging grooves 16 and 16' of the sliders 5 and 5' are situated inside the spaces 48 and 48'. The follower protrusions 9 and 9' of the sliders 5 and 5' are engaged with the guide slits 10 and 10', and stick out of the upper wall 6 and the lower wall 6'. The sliders 5 and 5', the follower protrusions 9 and 9', the cam grooves 8 and 8', and the lock arms 17 and 17' are all arranged point-symmetrically to each other. A tapered guide 49 for the connector casing 3 is formed on the outer periphery of the end of the female connector housing 1.

Figure 5:
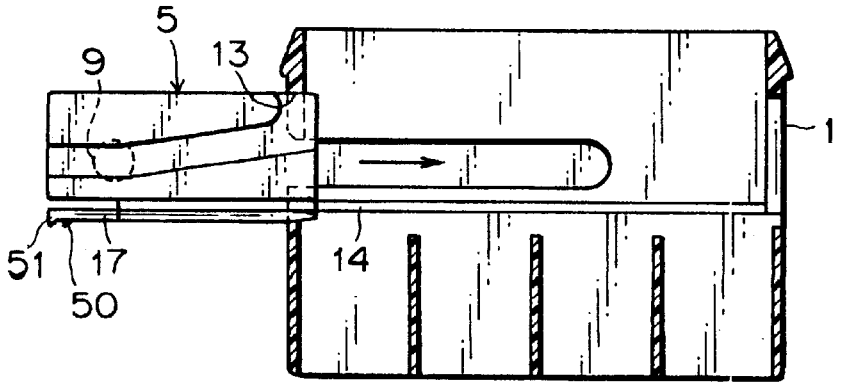
FIG. 5 is a vertical sectional view illustrating the female connector housing when a slider is being inserted into it.
Figure 6:
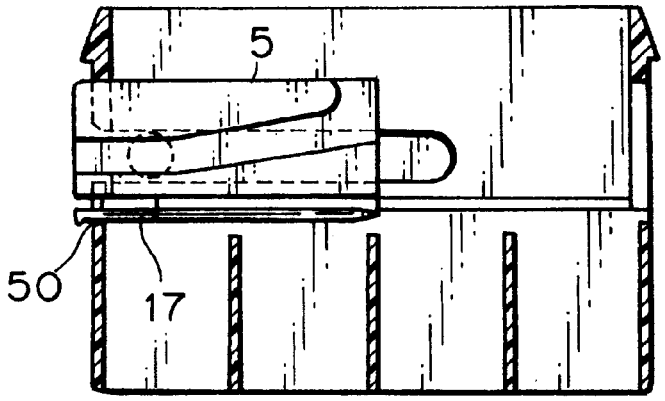
FIG. 6 is a vertical sectional view illustrating the female connector housing right before completion of the slider insertion.
Figure 7:
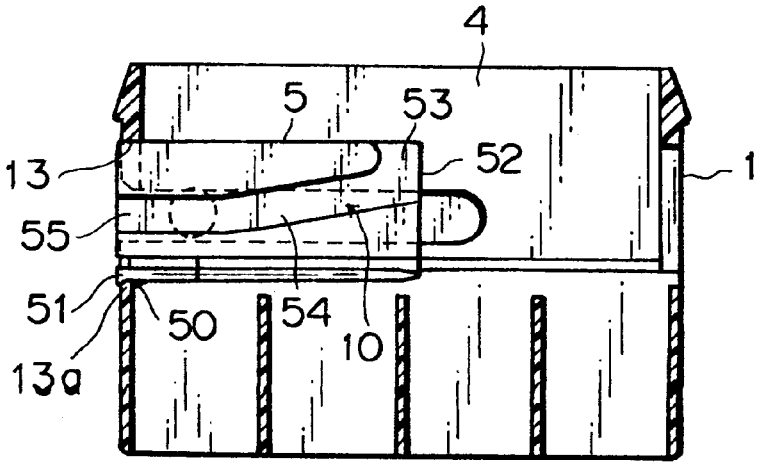
FIG. 7 is a vertical sectional view illustrating the locked state after the completion of the slider insertion.

As shown in FIGS. 5 to 7, the slider 5 is inserted through the slider insertion slit 13 on one side of the female connector housing 1. The engaging groove 16 of the slider 5 is engaged with the guide rail 14 of the female connector housing 1 in the direction perpendicular to the direction of connector engagement, as shown in FIG. 5. A protrusion 50 at the front edge of the flexible lock arm 17 on the rear side of the slider is then brought into contact with the front edge of the slider insertion slit 13, as shown in FIG. 6. As the slider 5 is pushed further, the lock arm 17 bends and enters further, so that the edge 13*a* of the slider insertion slit 13 are engaged between two protrusions 50 and 51, as shown in FIG. 7. Thus, being temporarily held in the initial position, the slider 5 is accommodated in the connector engaging chamber 4.

The edge 52 of the slider 5 is situated slightly on the slider insertion side of the center of the female connector housing 1, and the inlet 53 of the cam groove 10 is situated at the center of the housing 1. The cam groove 10 is formed by an inclined portion 54 which communicates with the inlet 53, and a horizontal portion 55 which communicates with the inclined portion 54. The pair of sliders 5 and 5' are inserted into the female connector housing 1 in opposite directions.

In this embodiment, the cam grooves 8 and 8' of the sliders 5 and 5' may be cam slits, the cam slits 34 and 34' of the connector casing 3 may be cam grooves, the slide streak plates 24 and 24' of the male connector housing 2 may be slide protrusions, the temporary engaging protrusion 27 may be a temporary engaging arm, and the flexible lock arm 32 of the connector casing 3 may be a lock protrusion.

Figure 8:
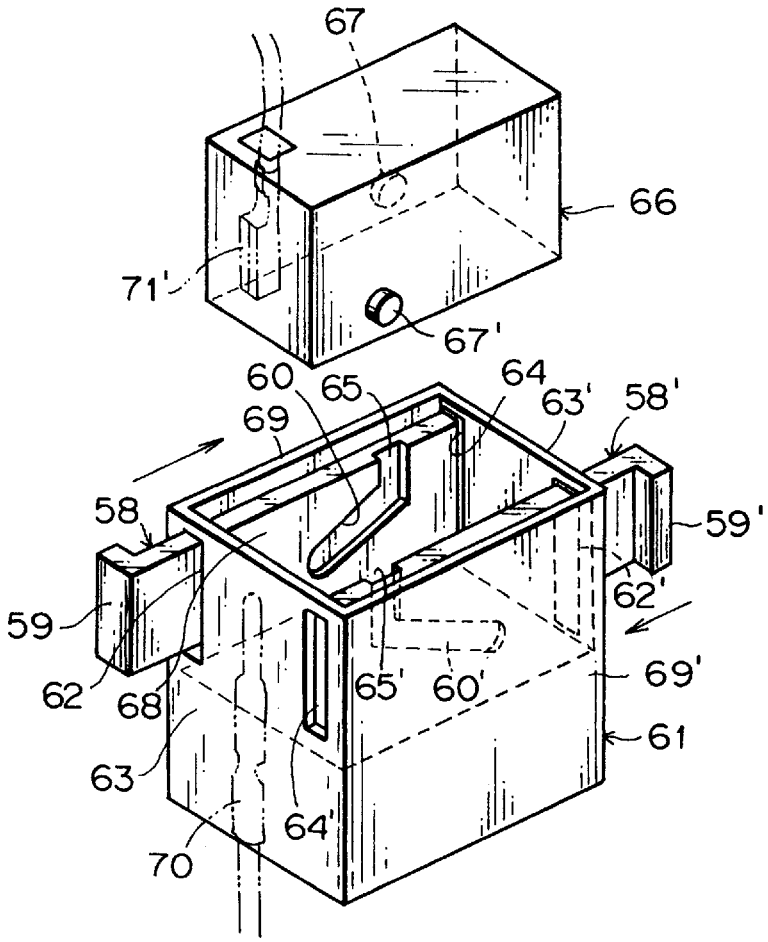
FIG. 8 is an exploded perspective view illustrating another embodiment of the low inserting force connector in accordance with the present invention.
Figure 9:
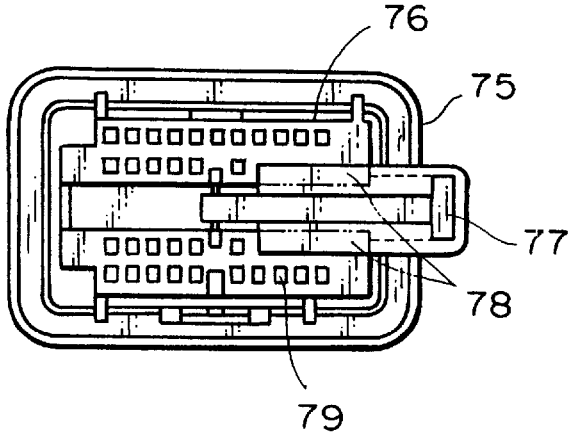
FIG. 9 PRIOR ART
FIG. 9 is a plan view illustrating an example of the prior art.
Figure 10:
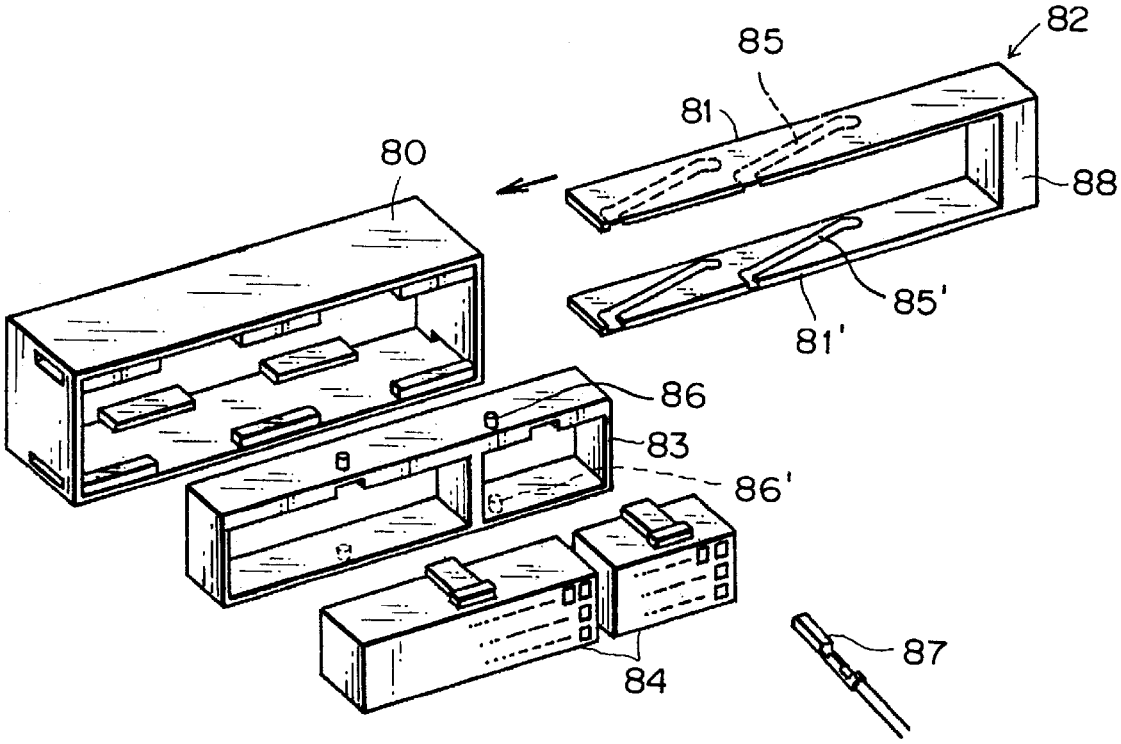
FIG. 10 PRIOR ART
FIG. 10 is an exploded perspective view illustrating another example of the prior art.

FIG. 8 illustrates another embodiment of the low inserting force connector according to the present invention.

This low inserting force connector is provided with a pair of long sliders 58 and 58'. The sliders 58 and 58' are inserted into slider insertion slits 62 and 62' along the front wall 69 and the rear wall 69' of a female connector housing 61. Handling portions 59 and 59' of the sliders 58 and 58' stick out of the slider insertion slits 62 and 62' of side walls 63 and 63'. The edges of the sliders 58 and 58' are situated close to slider through slits 64 and 64', so that the sliders 58 and 58' can penetrates through the female connector housing 61.

Cam grooves 60 and 60' of the sliders 58 and 58' have their inlets closer to the edges of the sliders than to the center of the female connector housing 61. Accordingly, stopper protrusions 67 and 67' of a male connector housing 66 are arranged point-symmetrically to each other. The sliders 58 and 58' have identical shapes and are arranged point-symmetrically to each other, as in the first embodiment.

With the sliders 58 and 58' being pulled out as shown in FIG. 8, the male connector housing 66 is initial-engaged with a connector engaging chamber 68 of the female connector housing 61, and the sliders 58 and 58' on both sides are pushed in opposite directions. As a result, the stopper protrusions 67 and 67' are guided along the cam grooves 60 and 60' in the direction of connector engagement, thereby engaging the male connector housing 66 with the female connector housing 61.

The male connector housing 66 is disengaged from the female connector housing 61 by pulling the handling portions 59 and 59' of the sliders 58 and 58'. The connector housings 61 and 66 are not provided with a slide engaging portion (denoted as 20 in FIG. 1) or lock arms (denoted as 39 in FIG. 1), but engaged with and disengaged from each other by hand. Male terminals 70 are inserted into the female connector housing 61, while female terminal 71 are inserted into the male connector housing 66, thereby forming a female connector and a male connector.

In a case where the two sliders 58 and 58' slide in the same direction, i.e., the sliders 58 and 58' are line-symmetrically arranged, the force exerted from the sliders 58 and 58' will act in the same direction. As a result, the force acts only upon the male connector and dislocates it. This makes it difficult to engage and disengage the connectors. According to this embodiment as well as the first embodiment, however, the force from the sliders point-symmetrically acts on the connectors, and the balance in force is kept when the sliders are handled. Thus, the connectors can be smoothly engaged and disengaged.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A low inserting force connector, comprising:

a first connector housing having walls facing each other;

a pair of sliders slidably arranged along the walls of the first connector housing and arranged point-symmetrically thereon and provided with cam portions;

a second connector housing provided with stopper protrusions to be engaged with the cam portions; and a connector casing for accommodating and engaging the first connector housing and the second connector housing, wherein the engagement of the first and second connector housings caused the stopper protrusions to engage the cam portions of the pair of sliders causing the pair of sliders to slide in opposite directions thereby guiding the complete engagement of the first and second connector housings.

2. The low inserting force connector according to claim 1, wherein the pair of sliders are accommodated on opposite walls of the first connector housing.

3. low inserting force connector according to claim 2, wherein inlets of the cam portions are situated in the center of the first connector housing extending in the transverse direction of the first connector housing, and the stopper protrusions are situated in the center of the second connector housing.

4. The low inserting force connector according to claim 3, wherein the pair of sliders are provided with follower protrusions, and the first connector housing is point-symmetrically provided with guide slits for receiving the follower protrusions.

5. The low inserting force connector according to claim 4, wherein the first connector housing and the second connector housing can be inserted into the connector casing, and the connector casing is point-symmetrically provided with cam slits for the follower protrusions.

6. The low inserting force connector according to claim 5, wherein the second connector housing is provided with engagement-direction sliding portions and a temporary engaging portion, and the connector casing is provided with guide portions to be engaged with the sliding portions, and a locking mechanism to be engaged with the temporary engaging portion.

7. The low inserting force connector according to claim 6, wherein the first connector housing and the connector casing are provided with locking portions to be engaged with attachment portions of mating objects.

* * * * *